United States Patent [19]

Happe

[11] 4,273,020

[45] Jun. 16, 1981

[54] METHOD OF CONSTRUCTING TRUMPET OR OTHER BRASS INSTRUMENT

[76] Inventor: Ralph A. Happe, 15400 Belgrade St., Apt. 35, Westminster, Calif. 92683

[21] Appl. No.: 42,109

[22] Filed: May 24, 1979

[51] Int. Cl.[3] ..... G10D 7/10

[52] U.S. Cl. ..... 84/394; 84/387 R

[58] Field of Search ..... 84/387–401

[56] References Cited

U.S. PATENT DOCUMENTS

| | | | |
|---|---|---|---|
| 1,385,202 | 7/1921 | Couturier | 84/387 X |
| 2,987,950 | 6/1961 | Kent | 84/388 |

FOREIGN PATENT DOCUMENTS

| | | | |
|---|---|---|---|
| 378157 | 8/1907 | France | 84/398 |
| 311809 | 5/1929 | United Kingdom | 84/398 |

*Primary Examiner*—Lawrence R. Franklin

*Attorney, Agent, or Firm*—Knobbe, Martens, Olson, Hubbard & Bear

[57] ABSTRACT

A method of constructing a trumpet or other brass instrument is disclosed wherein a zone of increased taper is formed on the cylindrical inner surface of the mouthpipe to provide an improved air column between the mouthpiece and valve sections of the instrument. The zone of increased taper is critically positioned along the length of the mouthpipe to coincide with the pressure maximum points of selected notes in the upper octave of the normal playing range of the instrument to yield a chromatic scale that is nominally true to desired pitch.

17 Claims, 7 Drawing Figures

METHOD OF CONSTRUCTING TRUMPET OR OTHER BRASS INSTRUMENT

BACKGROUND OF THE INVENTION

The present invention relates to a method of constructing brass instruments and more particularly to a method of forming the mouthpipe of a brass instrument to include a zone of increased taper which significantly improves the intonation of the entire upper octave of the instrument's normal playing range. (I.e., for purposes of this application, brass instruments comprise wind instruments having a cup mouthpiece and a cylindrical bore.)

Although the origins of brass instruments have been traced back hundreds of years to man's primitive ancestors, the basic form of the modern valved trumpet derived in the early 1800's. Since that time, consistent efforts have been made to improve the harmonic or intonation qualities of the instrument. To date, most of these improvements have focused upon the configuration of the bell portion of the trumpet.

In relation to the bell portion, it has been found that by flaring the open end of the trumpet to increase in diameter as the opened end is approached, the frequencies of the lower note resonances are shifted upward. Additionally, if the total length of the trumpet is properly adjusted for the particular bell shape, the higher note resonances will remain unchanged. Thus, with a properly shaped bell portion, the majority of note frequencies will be shifted into a form approximating a true harmonic series.

Although these improvements have proven beneficial in their general application, there exists inherent limitations in their operation which must be constantly corrected during playing by the musician. In particular, it is well known that trumpets constructed of conventional design fail to provide a chromatic scale that is nominally true to desired pitch for the entire upper octave of the instrument. (I.e., from the D natural ($D_5$) above the 4 partial C-natural ($C_5$) to the A natural ($A_5$) above.) Thus, with a conventional soprano trumpet in "C", the $E_5$ (659 Hz) note is typically flat enough to be audibly detectable in many playing situations, whereas the $F_5$, $G_5$ (740 Hz) G sharp$_5$ (831 Hz) and $A_5$ (880 Hz) notes are all very sharp. Heretofore, to intonate these upper octave notes in proper pitch, the musician would be required to conscienciously correct these normally out-of-tune notes by either extending a valve slide and/or false fingering of the trumpet valves.

Additionally, in the conventional trumpet design, the tuning slide is utilized to initially tune the instrument to desired pitch, being typically pulled outward away from the upper branch through a distance of $\frac{3}{8}$ to $\frac{3}{4}$ of an inch in order for the musician to play at a pitch corresponding to A=440 Hz (standard orchestration pitch). This extension of the tuning slide locally increases the bore of the instrument both in the upper and lower branch which flattens certain notes (i.e., the D sharp$_5$ and $E_5$) on the chromatic scale as well as produces turbulence within the instrument. This turbulence adversely affects the playability or action of the instrument which must further be constantly compensated for by the musician. Thus, there exists a need in brass instruments for a construction which corrects the chromatic scale throughout the entire upper octave of the normal playing range without adversely affecting the action and total resonance of the instrument.

SUMMARY OF THE PRESENT INVENTION

The present invention provides a novel construction for trumpets and other brass instruments which results in an improved acoustical shape of the air column between the mouthpiece and valve section of the instrument. This improved acoustical shape comprises a zone of increased taper which is precisely located for each particular instrument along the length of the mouthpipe and merges smoothly with the main cylindrical bore of the instrument. The zone of increased taper coincides with the pressure maximum points of the standing waves of selected notes to correct the pitch of the notes propogated through the instrument.

The improved instrument construction of the present invention specifically results in improved intonation (i.e., corrected pitch) in the chromatic scale from the D natural above the 4th partial (C natural) to the B natural and above without adversely altering the remaining playing range of the instrument. For example, when the construction of the present invention is employed on a soprano "C" trumpet, the 5th partial E natural is raised (as compared with conventional trumpet construction) to its proper pitch in the tempered scale and the 6th partial G natural is lowered (as compared with conventional construction) to its proper pitch. Further, the construction of the present invention also raises the normally flat E flat note immediately above the 5th partial and lowers the normally sharp G sharp and A natural above the 6th partial. As such, the present invention provides a brass instrument which is capable of intonating a chromatic scale that is nominally true to pitch for the entire upper octave of the instrument and thereby eliminates the need to consciously employ valve slide extensions and false fingering techniques heretofore required of musicians during playing of the instrument.

Further, the present invention eliminates the manditory incorporation of a movable double branch tuning slide with tuning of the instrument being accomplished by the position of the mouthpipe. Moreover, the mouthpipe is constructed to merge smoothly with the main cylindrical bore of the instrument thereby eliminating the zone of locally increased bore attendant with the conventional trumpet's tuning slide design.

DESCRIPTION OF THE DRAWINGS

These and other features of the present invention will become more apparent upon reference to the drawings wherein.

DETAILED DESCRIPTION OF THE PREFERRED EMBODIMENT

Figure 1:
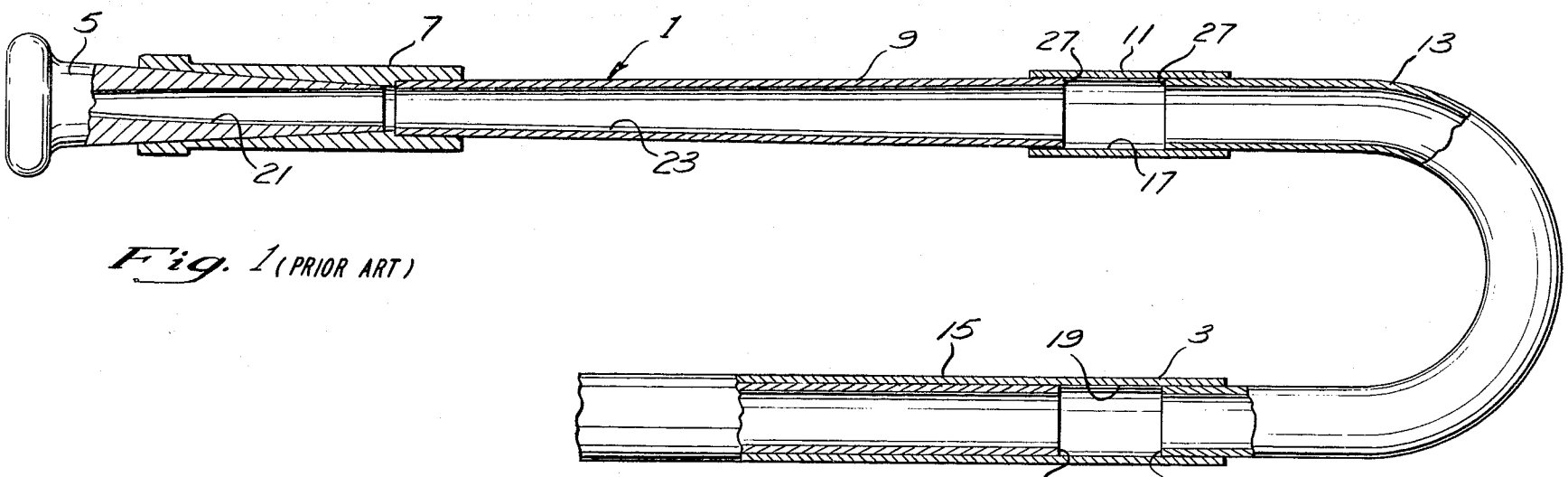
Fig. 1 (PRIOR ART)
FIG. 1 is a cross-sectional view of the upper and lower branch of a conventional trumpet showing the mouthpiece, mouthpipe, and tuning slide and depicting the zones of increased bore.

Referring to FIG. 1, there is shown the upper and lower branch 1 and 3, respectively, of a conventional trumpet. The upper branch 1 is composed of a mouthpiece 5, mouthpiece receiver 7, mouthpiece (or lead-pipe) 9, and a tuning slide receiver 11 which are connected in an end-to-end relationship. As is well known, a valve set (not shown) and valve extension (not shown) are additionally included to selectively vary the effective tubing length of the instrument. Typically, the tuning slide receiver 11 is rigidly connected at one end to the mouthpipe 9 (as by a solder joint) and slidingly receives at the other end one leg of a tuning slide 13 which interconnects the upper and lower branches 1 and 3, respectively. The lower branch 3 additionally includes a tuning slide receiver 15 which similarly receives the lower leg of the tuning slide 13. As will be recognized, by manually sliding the tuning slide 13 toward and away from the mouthpiece 5, the effective tubing length of the instrument may be varied to properly tune the instrument to a desired pitch. Additionally, the extension of the tuning slides forms an upper and lower zone of increased bore 17 and 19 on both the upper and lower branches 1 and 3, respectively, of the instrument, which, as will be explained in more detail below, may adversely effect the intonation of the instrument.

The mouthpiece 5 and mouthpipe 9 are both formed having a tapered or conical shaped inner wall 21 and 23 which has been found to yield a suitable air column for the intonation of a harmonic standing wave series. As is well known, an energy impulse may be created by expelling air under pressure through the mouthpiece 5 to produce a vibration. The mouthpiece 5 and mouthpipe 9 as well as the remainder of the trumpet provides an open-ended air column which propogates the standing wave produced by the vibration.

Figure 3:
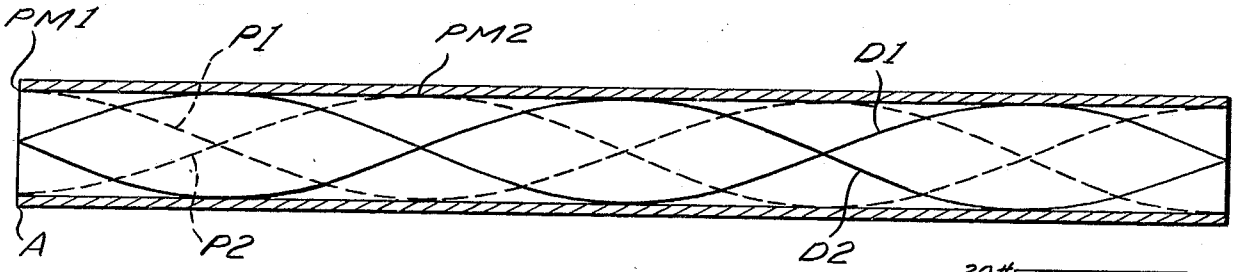
FIG. 3 is a schematic representation of the displacement and pressure curves of the standing wave generated in a trumpet.

Referring to FIG. 3, the details of the standing wave produced within the instrument are illustrated schematically. At point A (corresponding to the throat of the mouthpiece 5 in FIG. 1), the expulsion of air by the musician generates a compression impulse which moves within the tube 22 of the trumpet from left to right. This compression impulse produces a displacement impulse $D_1$ which additionally travels within the tube 22 from left to right) in a sinusoidal wave configuration. Upon reaching the open end B of the air column (representing the bell portion (not shown) of the instrument), the displacement impulse $D_1$ is reflected unchanged in the opposite direction (i.e., from right to left), producing a reflected displacement impulse $D_2$. Since the displacement curves $D_1$ and $D_2$ are mirror images of one another, a standing longitudinal displacement wave is produced within the tube 22 of the instrument.

As the displacement waves $D_1$ and $D_2$ travel within the tube 22, the air molecules of the air column are pulled apart and crowded together creating regions of lower and higher pressure, respectively. Thus, a pair of pressure waves $P_1$ and $P_2$ may be plotted within the air column corresponding to the displacement waves $D_1$ and $D_2$.

As shown in FIG. 3, at the open end of the tube 22, the pressure initiates at a maximum value $PM_1$ (i.e., the 1st pressure maximum point) and propogates as a sinusoidal wave $P_1$ through the length of the air column having a 2nd pressure maximum point $PM_2$, etc. Similarly, a second sinusoidal wave $P_2$ propogates through the air column in a direction opposite $P_1$ and following the reflected displacement curve $D_2$. As shown, the pressure curves $P_1$ and $P_2$ are out of phase with the displacement curves $D_1$ and $D_2$ such that maximum pressure is developed at points $PM_1$ and $PM_2$ corresponding to minimum displacement within the tube 22.

Although for illustration purposes FIG. 3 has been presented with a straight cylindrical tube air column configuratiion, the same principles apply to conical shaped air columns with the only exception being the elongation of the wave series as they expand in an increasing area air column. Thus, by propogating the standing wave in a conical shaped air column, the location of maximum pressure points $PM_1$ and $PM_2$, etc., along the air column may be longitudinally expanded or displaced along the length of the tube. A more complete discussion of the propogation of standing waves through brass instruments is presented in the ACOUSTICAL FOUNDATIONS OF MUSIC, 2nd edition, John Backus, 1977, W. W. Norton & Company, Inc., the disclosure of which is expressly incorporated herein by reference.

As will be recognized, each note initiated by a musician into the mouthpiece 5 of the trumpet will generate a displacement and pressure curve series similar to that shown in FIG. 3 with each note having a different sinusoidal wave pattern and varying locations of their maximum pressure $PM_1$ and $PM_2$ and maximum displacement points along the air column.

Based upon this physical relationship of standing waves in air columns, it has long been known that by locally increasing the bore (i.e., the diameter) of the air column at the location of a pressure maximum point of a particular note, the pitch of that particular note or any other note having a pressure maximum point at the same location will be lowered.

Thus, during playing of the conventional trumpet of FIG. 1, the notes generated by the musician whose pressure maximum points are located in either of the zones of increased bore 17 and 19 will have their pitch lowered. In conventional "C" trumpet designs, the particular notes having their pressure maximum points $PM_2$, etc., coincident with the zones of increased bore 17 and 19 are the D sharp 5 and $E_5$ notes. As such, these two notes are normally out-of-tune in conventional trumpet designs.

Thus, heretofore musicians playing a conventional trumpet were required to consciously correct the normally out-of-tune notes as by false valving, "lipping", or valve slide extension techniques.

Further, by use of the conventional tuning slide design, a shoulder 27 is formed at both ends of the zones of increased bore 17 and 19 by the difference in diameters between the tuning slide 13 and the upper and lower branch 1 and branch 3 of the instrument. These shoulders 27 often disrupt the normal sinuosidal wave of the note propogated through the instrument and increase turbulence within the air column which may adversely effect the sound of the instrument.

Figure 2:
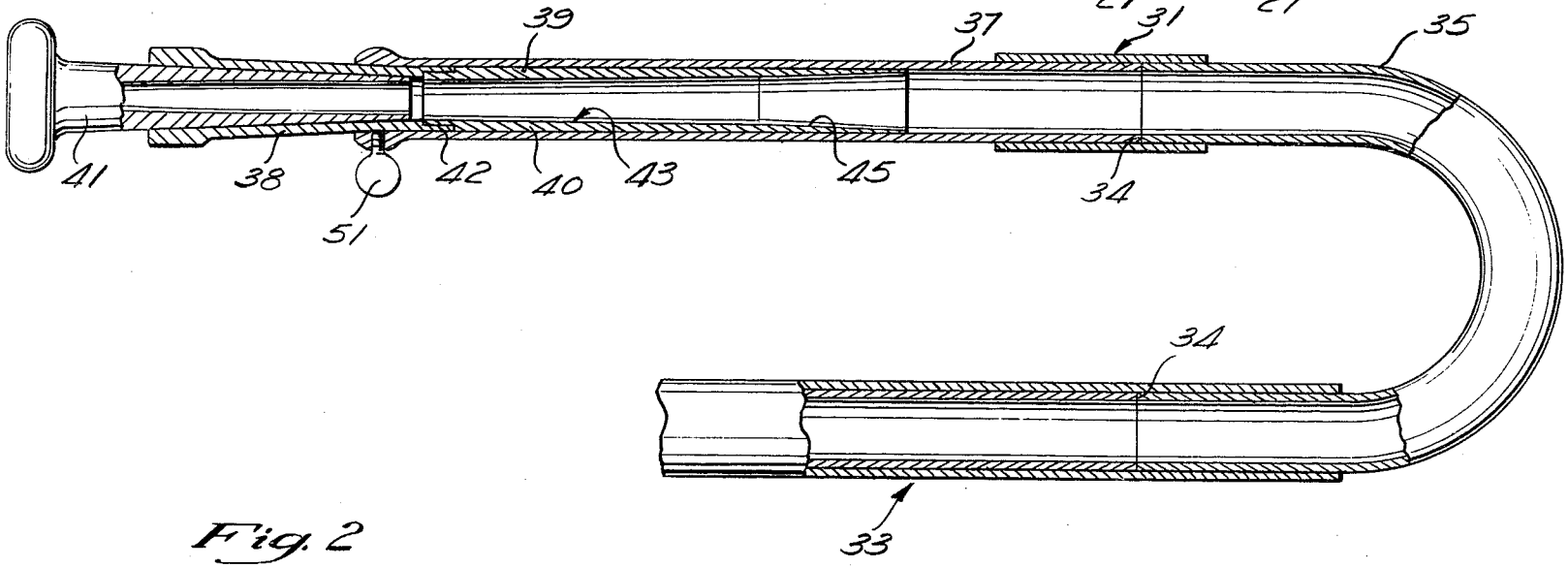
FIG. 2 is a cross-sectional view of the upper and lower branch of a trumpet constructed in accordance with the present invention showing the mouthpiece, mouthpipe, and mouthpipe receiver and depicting a zone of increased taper.

Referring to FIG. 2, the modified construction of the present invention which provides an improved acoustical shape of the air column of the trumpet is shown. The construction includes an upper and lower branch 31 and 33 which are interconnected by way of a conventional tuning slide 35. However, in the preferred embodiment, the tuning slide 35, although being typically reciprocal, which is desirable for cleaning purposes as in a conventional trumpet, is continuously maintained in its retracted position during playing such that a continuous bore diameter 34 is maintained at its interface with the upper and lower branches 31 and 33. As such, the prior art zones of increased bore (17 and 19 in FIG. 1) and the turbulence producing shoulders (27 in FIG. 1) are completely eliminated by the present invention construction.

The upper branch 31 is preferably formed as the straight cylindrical tubular section 37 which slidingly receives at one end thereof a mouthpipe assembly 39. The mouthpipe assembly 39 comprises an elongate tube being preferably formed by a mouthpiece receiver section and a bore section 38 and 40, respectively, which are mounted to one another as by a solder joint 42. The mouthpiece 41 is mounted to the receiver section 38 in a well known manner and the entire mouthpipe assembly 39 may reciprocate within the length of the tubular section 37 and be locked in a desired position by a clamping screw 41.

The mouthpipe assembly 39 includes an internal bore 43 formed in a conical or tapered configuration which is maintained in a substantially lineal configuration throughout the majority of its length. However, at the distal end thereof, the taper of the internal bore 43 is increased to provide a zone of increased taper 45. This zone of increased taper 45 has been found to correct certain intonation faults in the instrument as will be discussed in more detail below.

To initially tune the trumpet of the present invention to a desired orchestral pitch, it is not necessary and actually undesirable to reciprocate the tuning slide 35 within the upper and lower branches 31 and 33 as in the conventional trumpet design, but rather the mouthpipe assembly 39 (and thus the mouthpiece 41) need only be reciprocated within the tubular section 37. By this reciprocation, the effective length of the air column in the trumpet is altered thereby adjusting the overall pitch of the instrument.

The particular location of the zone of increased taper 45 of the present invenion as well as the amount or slope of increased taper is critical and varies between individual instruments but in all cases is maintained such that the zone 45 coincides with the maximum pressure points of the notes of the chromatic scale desired to be corrected. In this same regard, the taper of the substantially cylindrical bore 43 of the bore section 40 which is formed similar to the tapered mouthpipe of a conventional trumpet must be maintained unchanged to insure that the many desirable pitch qualities of the conventional trumpet are retained.

While being played, the zone of increased taper 45 of the present invention functions to selectively increase the bore diameter of the air column of the instrument. As such, particular notes having their pressure maximum points located within the zone 45 are effectively lowered in pitch. By properly positioning the zone 45 along the length of the air column and determining the amount of increased slope of the taper zone 45, the pitch of multiple notes may be lowered or corrected in varying magnitude.

With particular reference to a soprano "C" trumpet, the applicant has found that the normally out-of-tune upper octave (i.e., from the D natural above the 4th partial (C natural) to the A natural above) may be corrected by initiating the zone of increased taper at a distance of approximately 2.75 plus or minus 0.065 inches from the end of the mouthpiece 41. This particular location has been experimentally determined to be between the 2nd pressure maximum points (as shown in FIG. 3) of the $A_5$ and A sharp 5 notes such that the zone of increased taper lowers the pitch of the $A_5$ note without lowering the pitch of the A sharp 5 note which is a half-tone higher along the chromatic scale.

Figure 4:
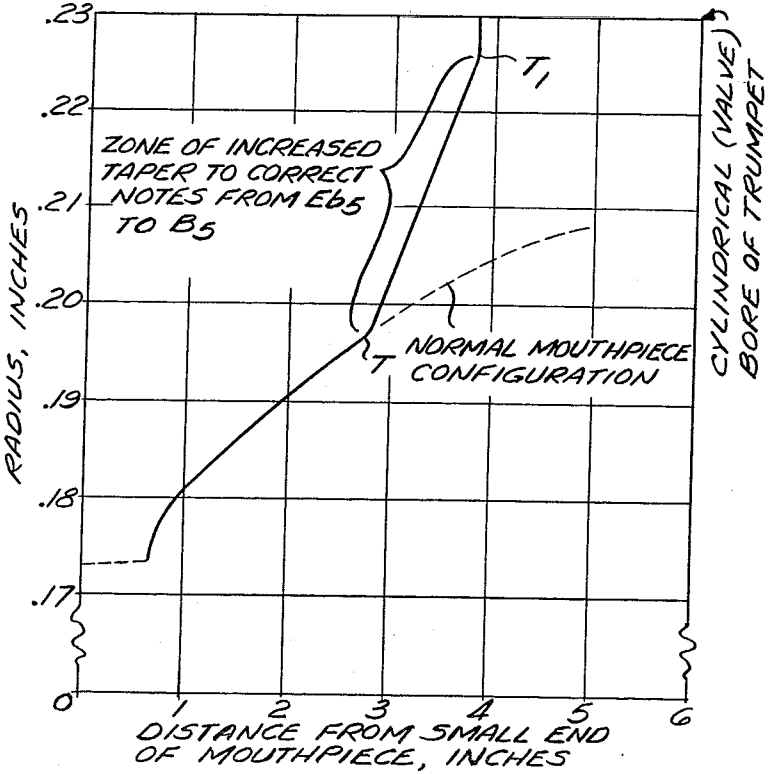
FIG. 4 is a graph of the radius of taper through the mouthpipe of the present invention plotted against the distance from the mouthpiece end of the mouthpipe.

Referring to FIG. 4, the particular construction of the taper within the bore section 40 of the mouthpipe assembly 39 for the soprano "C" trumpet (as illustrated in FIG. 2) is depicted in graphic form. As shown, the radius of the taper increases gradually to form a slight curved line which approximates a substantially linear rate (i.e., slope $\approx 0.011$) to a distance of approximately 2.75 inches from the small end of the mouthpiece 41. From this location (labelled T on FIG. 4) the taper is substantially increased (i.e., slope $\approx 0.020$) through a distance of slightly less than one inch (to a position $T_1$ indicated on FIG. 4). Thus, the magnitude of taper in the zone 45 (i.e., from $T_1$ to $T_2$) is approximately twice the magnitude of taper in the remainder of the bore section 40 of the mouthpipe assembly 39.

Figure 5:
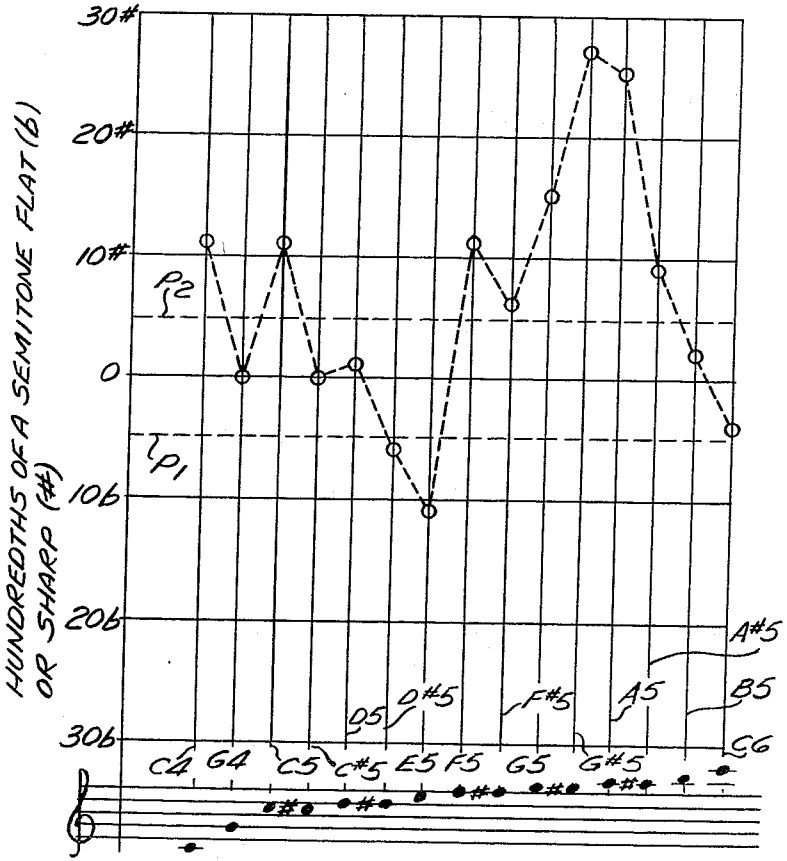
FIG. 5 is a graph of the deviation in semi-tones in the upper octave of the chromatic scale produced by the conventional trumpet construction of FIG. 1.
Figure 7:
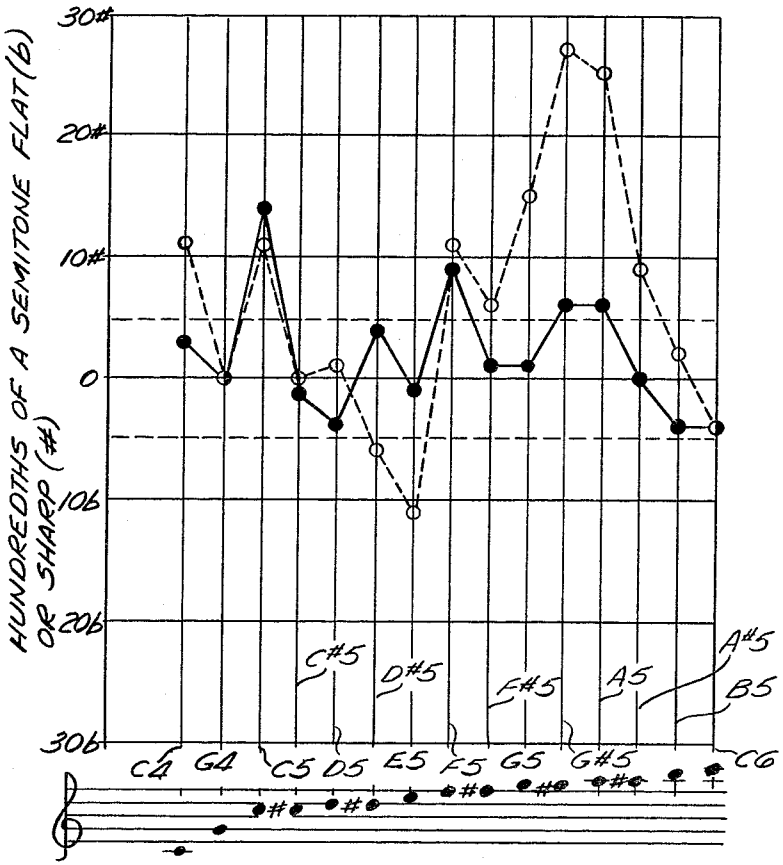
FIG. 7 is a graph of FIGS. 5 and 6 superimposed upon one another illustrating the decrease in deviation between a conventional trumpet and a trumpet produced in accordance with the teachings of the present invention.
Figure 6:
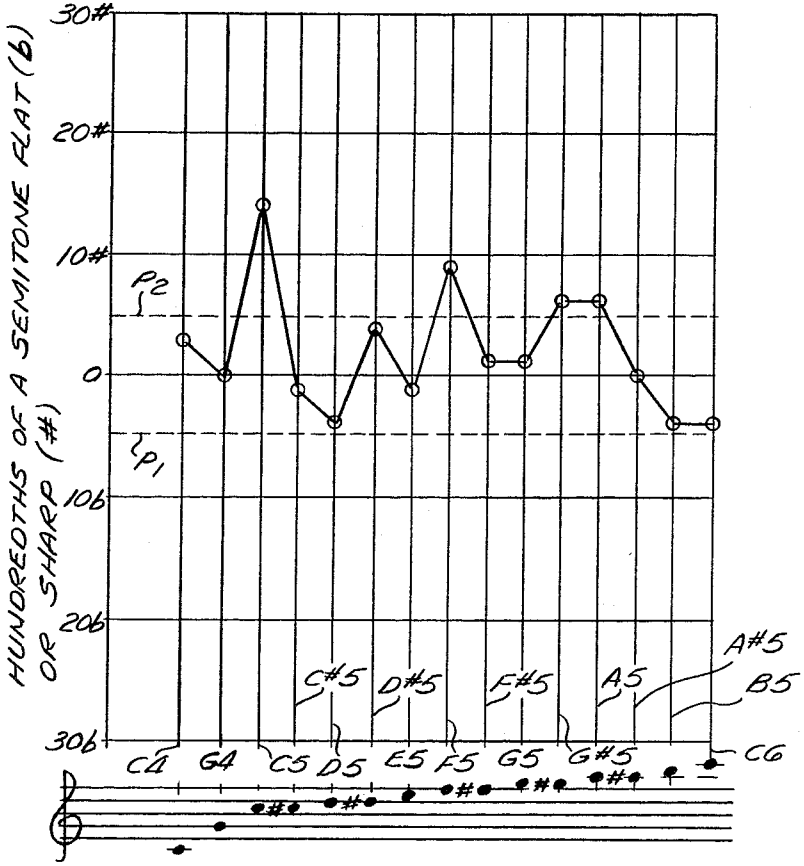
FIG. 6 is a graph of the deviation in semi-tones of notes of the upper octave of the chromatic scale produced by the trumpet shown in FIG. 2 and constructed in accordance with the present invention.

The dramatic improvement in the intonation of notes of the upper octave of the soprano "C" trumpet by use of the construction of the present invention is shown in FIGS. 5, 6, and 7. All test data plotted in FIGS. 5, 6, and 7 was obtained under tests conducted by carefully blowing the trumpet of FIGS. 1 and 2, using a commercial electronic tuning meter to determine the pitches produced.

In these figures, the notes of the upper octave of the trumpet are plotted on the horizontal axis of the graph whereas the amount of deviation from the true note on a tempered scale is plotted on the vertical axis (being represented in hundredths of a semi-tone flat or sharp). Further, since the human ear is capable of only differentiating discrepancies in pitch of approximately 5/100ths of a semi-tone, the graphs in FIGS. 5, 6 and 7 include a zone of acceptable deviation in pitch defined by the area between the horizontal lines labelled $P_1$ and $P_2$.

In FIG. 5, the data obtained by testing one of the most popular conventional design models of soprano "C" trumpets (Bach "large" bore C trumpet with 229 bell, manufactured by Vincent Bach Corporation, Elkhart, Indiana) is reproduced. For purposes of this series of tests, the instrument was tuned to $G_4$, a tuning which keeps the $C_6$ note comfortably within the limits of audible detectability, i.e., within the region between lines $P_1$ and $P_2$.

As shown, the conventional trumpet, although being utilized by many of the major symphony orchestras, has substantial intonation deficiences in the upper octave that would require conscious correction (as by slide extension or false fingering) by the performer. Thus, the $E_5$ is significantly flat enough to be audibly detected in many playing situations. Additionally, the $F_5$ (one-half tone higher) is quite sharp, being over 20/100ths of a semi-tone sharper in deviation than the $E_5$. Further, the G sharp 5 and E sharp 5 are extremely sharp, approximately 25 to 28/100ths of a semi-tone, respectively.

In FIG. 6, the data obtained in a similarly conducted test with the same model trumpet as FIG. 5 but modified according to the teachings of the present invention is reproduced. It is evident from the graph that all of the formerly defective note pitches are now substantially in tune with the majority of the notes lying between the lines $P_1$ and $P_2$. In particular, the notes D sharp 5, $E_5$, F sharp 5, and $G_5$ are all within the limits of human detectability. Further, the notes G sharp 5 and $A_5$ are only 1/100th semi-tone outside the limits of human detectability and can be easily lipped into tune with normal fingering and without valve slide extension.

This dramatic improvement in intonation made possible by the modified construction of the present invention is graphically depicted in FIG. 7 wherein FIGS. 5 and 6 are superimposed onto one another. As will be recognized, the modification of the present invention has lowered (by way of the zone of increased taper 45 in FIG. 2) the G $sharp_5$ and $A_5$ note approximately 27 and 26/100ths of a semi-tone, respectively, and additionally has raised (by way of the elimination of the zones of locally increased bore 17 and 19 in FIG. 1) the D $sharp_5$ and $E_5$ notes 10/100ths of a semi-tone. Thus, by way of the present invention, a chromatic scale that is nominally true to the desired pitch for the entire upper octave of the instrument is provided.

Those skilled in the art will realize that the teachings of the present invention, although being illustrated in relationship to a soprano "C" trumpet, are additionally applicable to other trumpets such as B flat, D, E flat, or F, as well as other cup mouthpiece brass instruments. Further, although for the key of C trumpet tested and disclosed herein, the beginning of the zone of increased tape is located precisely at 2.75 inches from the small end of the mouthpiece, other trumpets as well as other brass instruments may require a relocation of the zone of increased taper to correct the higher octaves which are normally out of tune. In this same regard, the amount or magnitude of increased taper of the present invention which is illustrated in FIG. 4 may be varied between the normal mouthpiece configuration (represented by the dash line in FIG. 4) to a line approaching vertical on the graph. In such a manner, any particular trumpet may be finely tuned to compensate for the discrepancies of the intonation of different instruments to produce a true tempered scale for an instrument.

I claim:

1. A method of constructing a musical wind instrument having a cup-shaped mouthpiece and a main bore section to correct the intonation of selected notes of the chromatic scale of said instrument comprising:

forming a mouthpipe having a conical-shaped axial aperture and mounted between said mouthpiece and said main bore section; and forming a zone of increased taper along the length of said conical-shaped aperture, said zone located to coincide with the pressure maximum points of said selected notes of said chromatic scale.

2. The method of claim 1 further comprising:

sizing the outside diameter of said mouthpipe slightly less than the inside diameter of said main bore section to reciprocate within said main bore section, said reciprocation of said mouthpipe tuning said instrument to a desired playing pitch.

3. The method of claim 2 further comprising:

forming one end of said mouthpipe to smoothly merge with said inside diameter of said main bore section.

4. A method of constructing a musical wind instrument having a cup-shaped mouthpiece, a mouthpipe including a conical-shaped axial aperture, a 1st tubing branch mounting said mouthpiece and said mouthpipe, a 2nd tubing branch, and a tubular slide member interconnecting said upper and lower branches to correct the pitch of selected notes of the upper octave of the instrument comprising:

sizing said mouthpipe to reciprocate within said 1st branch of said instrument; and locally increasing the taper of said conical-shaped axial aperture to form a zone of increased taper, said zone positioned at a distance from one end of said mouthpipe corresponding to the pressure maximum of said selected notes of said upper octave to correct the pitch of said selected notes without affecting the pitch of other notes with the normal playing range of said instrument.

5. The method of claim 4 further comprising:

forming said conical shaped axial aperture to merge smoothly with the inside diameter of said 1st tubing branch.

6. The method of claim 4 further comprising:

forming said tubular slide member to include an inside diameter equal to the inside diameter of said 1st and 2nd branches; and abutting said slide member tightly against said 1st and 2nd branches to provide a substantially smooth transition between said 1st and 2nd branches, said smooth transition eliminating zones of local turbulence within said instrument.

7. In a musical instrument of the trumpet-trombone family including a mouthpiece, a mouthpipe having an axial tapered bore, an upper tubing branch, a lower tubing branch, and a tubing member connecting said upper and lower branches, the improvement comprising:

a zone of increased taper formed along the length of said axial bore of said mouthpipe, said zone positioned to coincide with the pressure maximum points of only selected notes of the chromatic scale of said instruments to correct the pitch of said selected notes without adversely altering the pitch of the remaining notes within the normal playing ranges of said instruments.

8. The improved trumpet of claim 7 wherein said mouthpipe is mounted to reciprocate within one end of said upper tubing branch to increase the length of said upper tubing branch.

9. The improved trumpet of claim 8 further comprising means for locking said mouthpipe along the length of said upper branch to tune said instrument in a desired key.

10. The improved trumpet of claim 8 wherein one end of said mouthpipe is sized to provide a smooth transition between said mouthpipe and said upper tubing branch.

11. The improved trumpet of claim 7 wherein said tubing member is maintained in an abutted relationship with said upper and lower branches to eliminate any zones of locally increased diameter along the length of said upper and lower branches.

12. An improved mouthpipe for use in a musical instrument of the cup-shaped mouthpiece family comprising:

a tubular member adapted to mount a mouthpiece at one end, and be slidingly received in the main bore of said instrument at the other end;

a 1st conical-shaped aperture extending axially through a portion of said tubular member; and said 2nd conical-shaped aperture having a greater taper than said 1st aperture to provide a zone of increase taper, said zone located along the length of said tubular member at a distance from said one end of said tubular member corresponding to the pressure maximum points of preselected notes to correct the pitch of said preselected notes within the normal playing range of said instrument.

13. The improved mouthpipe of claim 12 wherein one end of said 2nd conical shaped aperture is shaped to form a smooth transition between said mouthpipe and said main bore of said instrument.

14. The improved mouthpipe of claim 12 wherein said zone of increased taper is positioned to coincide with the pressure maximum points of only said preselected notes so that the pitch of the other notes of said normal playing range are not affected.

15. A method of constructing a trumpet to correct the pitch intonation of the chromatic scale from the D natural note above the fourth partial C natural note to the B natural note above comprising:

forming a mouthpipe having a conical shaped axial aperture and mounted between the mouthpiece and the main bore section of said trumpet to include a zone of increased taper; and positioning said zone of increased taper along the length of said mouthpipe at a distance from one end of said mouthpiece corresponding to the second pressure maximum points of the notes of the chromatic scale between the F above the fourth partial and the A natural above.

16. The method of claim 15 wherein said zone of increased taper is approximately twice the amount of taper in said conical shaped aperture.

17. The method of claim 15 wherein said zone of increased taper is positioned at approximately 2.75 inches from said end of said mouthpiece.

* * * * *